United States Patent [19]

Dykes et al.

[11] Patent Number: 4,901,785

[45] Date of Patent: Feb. 20, 1990

[54] TWIN-BELT CONTINUOUS CASTER WITH CONTAINMENT AND COOLING OF THE EXITING CAST PRODUCT FOR ENABLING HIGH-SPEED CASTING OF MOLTEN-CENTER PRODUCT

[75] Inventors: Charles D. Dykes, Milton, Vt.; Sabah S. Daniel, Pittsburgh, Pa.; J. F. Barry Wood, 303 Shore Rd., Burlington, Vt. 05401

[73] Assignees: Hazelett Strip-Casting Corporation, Colchester, Vt.; USX Corporation, Pittsburgh, Pa.

[21] Appl. No.: 224,058

[22] Filed: Jul. 25, 1988

[51] Int. Cl.[4] ..... B22D 11/06; B22D 11/24

[52] U.S. Cl. ..... 164/481; 164/432; 164/444; 164/486

[58] Field of Search ..... 164/481, 486, 432, 431, 164/444

[56] References Cited

U.S. PATENT DOCUMENTS 4,367,783 1/1983 Wood et al. ..... 164/481 X
4,679,612 7/1987 Artz et al. ..... 164/431

FOREIGN PATENT DOCUMENTS 60-49840 3/1985 Japan ..... 164/431
62-24845 2/1987 Japan ..... 164/481

OTHER PUBLICATIONS

Petry, C. J. et al., Paper presented at the 28th Mechanical Working and Steel Processing Conference on Oct. 26–28, 1986, Pittsburgh, pp. 205–212.

*Primary Examiner*—Nicholas P. Godici
*Assistant Examiner*—J. Reed Batten, Jr.
*Attorney, Agent, or Firm*—Parmelee, Bollinger & Bramblett

[57] ABSTRACT

In continuously casting molten metal into cast product by a twin-belt machine, it is desirable to achieve dramatic increases in speed (linear feet per minute) at which cast product exits the machine, particularly in installations where steel cast product is intended to feed a downstream regular rolling mill (as distinct from a planetary mill) operating in tandem with the twin-belt caster. Such high-speed casting produces product with a relatively thin shell and molten interior, and the shell tends to bulge outwardly due to metallostatic head pressure of the molten center. A number of cooperative features enable high-speed, twin-belt casting: (1) Each casting belt is slidably supported adjacent to the caster exit pulley for bulge control and enhanced cooling of cast product. (2) Lateral skew steering of each belt provides an effective increase in moving mold length plus a continuity of heat transfer not obtained with prior art belt steering apparatus. (3) The exiting slab is contained and supported downstream from the casting machine to prevent bulging of the shell of the cast product, and (4) spray cooling is incorporated in the exit containment apparatus for secondary cooling of cast product.

24 Claims, 11 Drawing Sheets

20
22
5
5
141
141
136
124
135
135
102
126
144
142
152
150
128
138
102
61
60
130
154
129
134
146
127
137
132
28
61
60
28
140
139

TWIN-BELT CONTINUOUS CASTER WITH CONTAINMENT AND COOLING OF THE EXITING CAST PRODUCT FOR ENABLING HIGH-SPEED CASTING OF MOLTEN-CENTER PRODUCT

BACKGROUND

To couple a twin-belt casting machine in tandem with a regular rolling mill, in contrast with a planetary mill, for continuously casting steel product, the twin-belt caster must be operated at high speed for reasons explained in the next paragraph. This term "high speed" is intended to mean a linear output rate of at least 300 inches per minute (25 feet per minute).

When a hot cast steel slab enters a regular rolling mill at a significant lesser speed than defined above, there occurs undue transfer of heat from the product being rolled into the localized region of each mill roll in contact with the product. Thus, too much cooling of product occurs before exiting the rolling mill, and the rolls themselves become adversely affected by localized overheating of the working surfaces.

U.S. Pat. No. 2,640,235 disclosed cooling chambers or water jackets (44, 45, 46, 48, 49 and 50 as numbered in FIGS. 1, 5, 7 and 8 therein) adjacent to the outer surfaces of transversely bowed casting belts in the entrance section of a twin-belt caster. Other cooling chambers or water jackets (56 and 59 in FIGS. 1, 2 and 2*a*) were adjacent to the easting belts in the casting section of this machine. For preventing the pressure of the cooling water in these latter chambers from distorting the belts, electromagnetic attraction held the belts against non-magnetic copper or brass spacers (58 or 58*a*). Steering of each belt was accomplished, as shown in FIG. 6 therein, by twisting the orientation of the upstream pulley roller (19) about the axis of the belt-tensioning piston rod (21). It is noted in FIG. 1 and FIG. 9 of the above-mentioned patent that both casting belts (17 and 18) diverged away from the cast product before the belts had reached the respective downstream pulley rollers (25 and 40), which served as the belt drive rollers.

U.S. Pat. No. 2,904,860 showed the casting belts (14 and 16) extending adjacent to the cast product all of the way to the respective downstream pulley roller (130 and 122 in FIG. 2 therein). However, this caster included four pulley rollers (126, 134, 130 and 142 in FIG. 2 therein) for the upper casting belt (14) and three pulley rollers (118, 206 and 122) for the lower casting belt (16). Steering of the belts to run centrally was accomplished as shown in FIGS. 2 and 6 therein be skewing the axis of an intermediate roller (142 or 206, sometimes called a "third roller)" away from transverse relationship to the belt passing in contact with the respective steering roller. This third-roll steering arrangement depended in large measure upon frictional contact between the passing belt and the steering roller itself and was not fully effective or reliable due to variations in the coefficient of friction and in thermal conditions and minor imperfections in belt shape.

U.S. Pat. No. 3,036,348, and the related U.S. Pat. No. 3,123,874 disclosed a twin-belt caster wherein the upper casting belt (20 in FIG. 3 and FIG. 12 in 3,036,348) diverged from the cast product a considerable distance upstream from the exit pulley roll (78 in FIG. 12 of 3,036,348). Steering of the upper casting belt was accomplished by tilting the axis of the exit pulley roll (78) in a plane perpendicular to the plane of the casting region. The divergence of the upper casting belt from the cast product provided clearance for such exit pulley roll steering action. In this machine shown in U.S. Pat. No. 3,036,348 the lower casting belt (22) was steered by tilting the axis of the lower upstream pulley roll (80) in a plane perpendicular to the casting plane. FIGS. 13A and 13B therein explain the steering action produced by such tilting of the axis of a pulley roll.

U.S. Pat. No. 3,167,830 disclosed a steering arrangement similar to that for the upper belt in U.S. Pat. No. 3,036,348 wherein the axis of the exit pulley roll was tilted in a plane perpendicular to the plane of the casting region, except that in U.S. Pat. No. 3,167,830 the axes of both exit pulley rolls were tilted for steering the respective belts. In FIGS. 3, 6 and 7 of U.S. Pat. No. 3,167,830 was shown a smaller diameter belt back-up roller (46) positioned very close to the entrance pulley rolls (28 and 30). The other belt back-up rollers (44) were larger in diameter than this first back-up roller (46).

U.S. Pat. No. 3,310,849 described a four pulley roll arrangement for both belts in a twin-belt caster. Steering of a belt was obtained by simultaneously tilting the axis of both downstream pulley rolls, as shown in FIGS. 7 and 8 therein, in a plane perpendicular to the casting plane. It is noted in FIGS. 2 and 7 therein that the casting belts diverged from the cast product before reaching the exit pulley rolls (22) and (26) in order to provide clearance for the belt steering action.

U.S. Pat. No. 3,878,883 and related U.S. Pat. Nos. 3,949,805 and 3,963,068 disclosed steering apparatus for tilting the axis (144 in FIGS. 16, 17 and 18) of the exit pulley roll (22 or 18) in a plane perpendicular to the casting plane.

FIGS. 1, 2 and 3 herein illustrate the relationships involved in such prior art belt steering arrangements where the axis of each exit pulley roll 20 and 22 was tilted, as shown in FIGS. 2 and 3 herein, in a plane perpendicular to the plane of the casting region C for steering the respective upper and lower casting belts 24 and 26. After each casting belt 24 and 26 had progressed past the last back-up roller 28, it was necessary to diverge the belt away from the casting plane C to provide clearance with respect to the exiting cast product P. This clearance was necessary, as illustrated by FIG. 2, for allowing tilting (angle $\theta$) of the exit pulley rolls 20 and 22 without causing them or the revolving belts to disturb the freshly cast product P exiting from the twin-belt machine.

In the machine of U.S. Pat. No. 2,904,860, steering was accomplished by a third roller as shown in FIG. 6 of that patent. Thus, it was not necessary for the casting belts to diverge from the exiting cast product. However, such third roller steering action was not entirely satisfactory for reasons as discussed above.

SUMMARY OF THE INVENTION

In order to accomplish high-speed operation of a twin-belt caster in producing cast steel product, there are a number of features cooperatively employed: (1) Each casting belt is slidably supported inside the caster and adjacent to the caster exit pulley roll for bulge control and for enhanced cooling of the cast product. (2) Lateral skew steering of each belt provides an effective increase in the moving mold length because each casting belt can hug the cast product all of the way to the downstream pulley roll. Thus, a continuity of heat transfer is provided which was not previously obtained with prior belt steering arrangements. (3) The exiting cast product is contained and supported outside the caster for resisting bulging of the relatively thin cast skin or shell, and (4) spray cooling is included in the exit containment apparatus for secondary cooling of the freshly cast product exiting from the twin-belt caster.

BRIEF DESCRIPTION OF THE DRAWINGS

The various features, aspects, objects and advantages of the present invention will become more fully understood from a consideration of the following detailed description of the presently preferred embodiments of the invention, together with the accompanying drawings, which are not drawn to scale but rather are arranged to illustrate clearly the present invention, and wherein corresponding reference numerals are used to indicate corresponding elements throughout the various views.

FIG. 2 illustrates tilting (angle $\theta$) of the respective exit pulley roll axis for steering the associated casting belt.

FIG. 4 shows the belt-support platens extending between the last back-up rollers 28 and the exit pulley rolls 20 and 22.

FIG. 5 shows the fins of the lower platen for allowing cooling water to flow at high velocity along the inner surface of the lower casting belt (not shown in FIG. 5).

FIG. 7 is contrasted with FIG. 3.

DETAILED DESCRIPTION OF PRESENTLY PREFERRED EMBODIMENT

Figure 1:
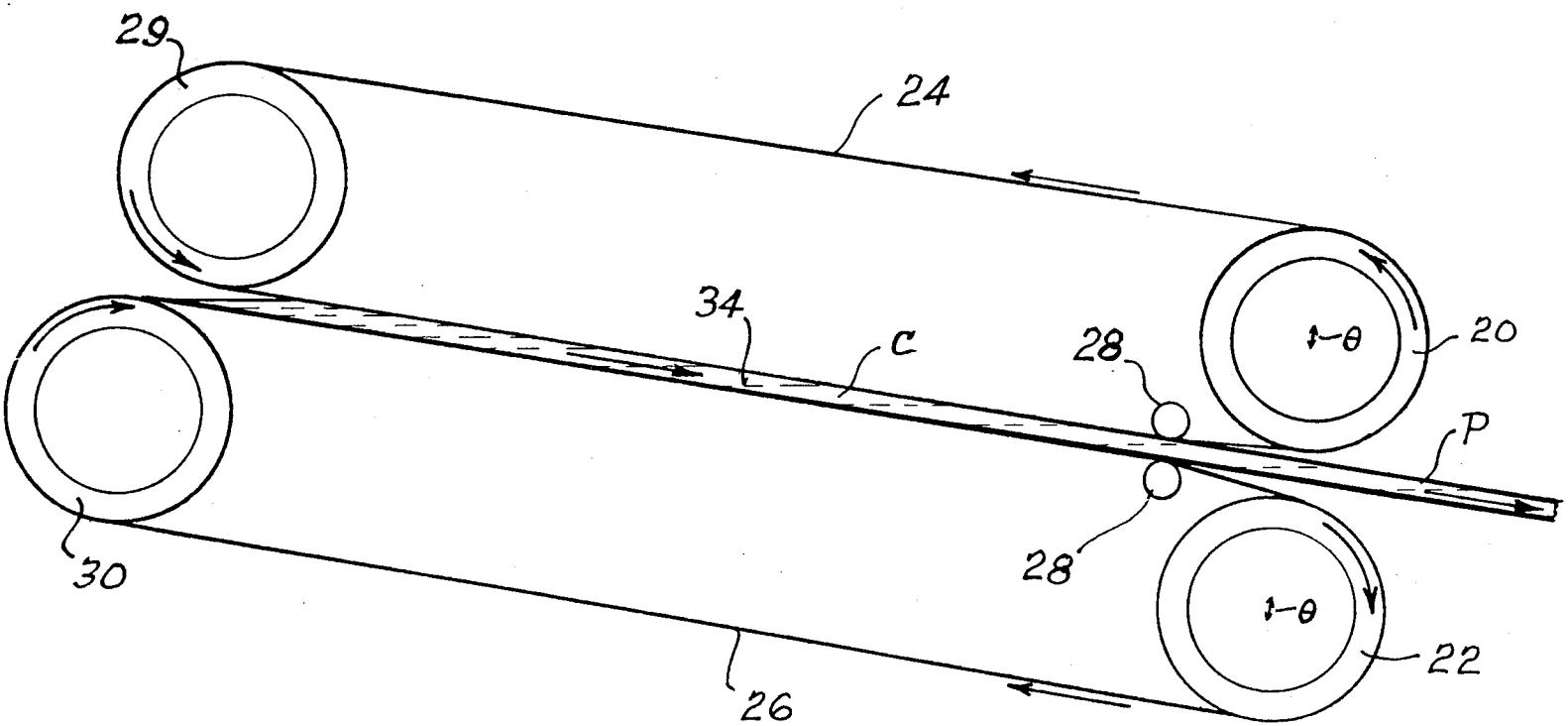
FIG. 1 (PRIOR ART)
FIG. 1 is a schematic side elevational view of the moving mold casting region C and the two belts in a prior art continuous metal casting machine of the twin-belt type.

In more recent twin-belt casting machines, as illustrated in FIG. 1, the upper and lower casting belts 24 and 26 have each been revolved by two main pulley rolls; whereas earlier twin-belt casters, as shown in the patents discussed in the introduction, sometimes employed more than two main pulley rolls for each belt. In the machine of FIG. 1, the upper and lower belts 24 and 26 are driven by the entrance pulley rolls 29 and 30, respectively, and the belts are tensioned and steered by the exit pulley rolls 20 and 22.

The casting belts 24 and 26 are guided and restrained as moving mold members by multiple finned backup rollers 28 (only two are shown in FIG. 1 for clarity of illustration) so that the opposed belt casting or mold surfaces are maintained in a preselected relationship throughout the length of the moving mold region C. These finned backup rollers 28 are of the type shown and described in U.S. Pat. No. 3,167,830.

A flexible, endless side moving retaining dam 32 (FIG. 11), usually called an edge dam, is disposed on each side of the mold region for confining the molten metal 34. The casting belts 24 and 26 are normally parallel to each other through the mold region C up to the last back-up rollers 28 (FIG. 1).

The casting belts in recent prior art twin-belt casters diverged from the exiting cast product P after passing the last pair of backup rollers 28, in order to provide clearance for the steering action being accomplished by tilting the exit pulley rolls 20 and 22, as indicated by the angle $\theta$.

Figure 2:
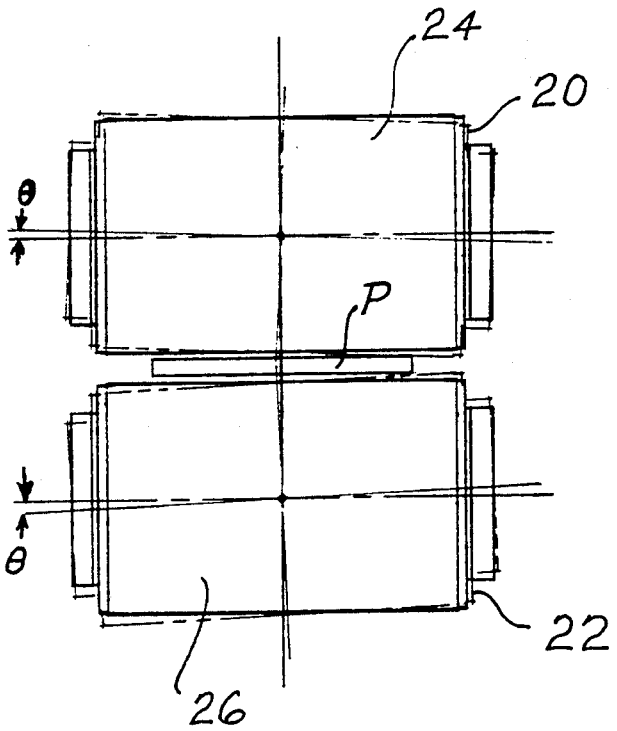
FIG. 2 (PRIOR ART)
FIG. 2 is a schematic elevational view of the exit (downstream) end of the twin-belt caster of FIG. 1.
Figure 3:
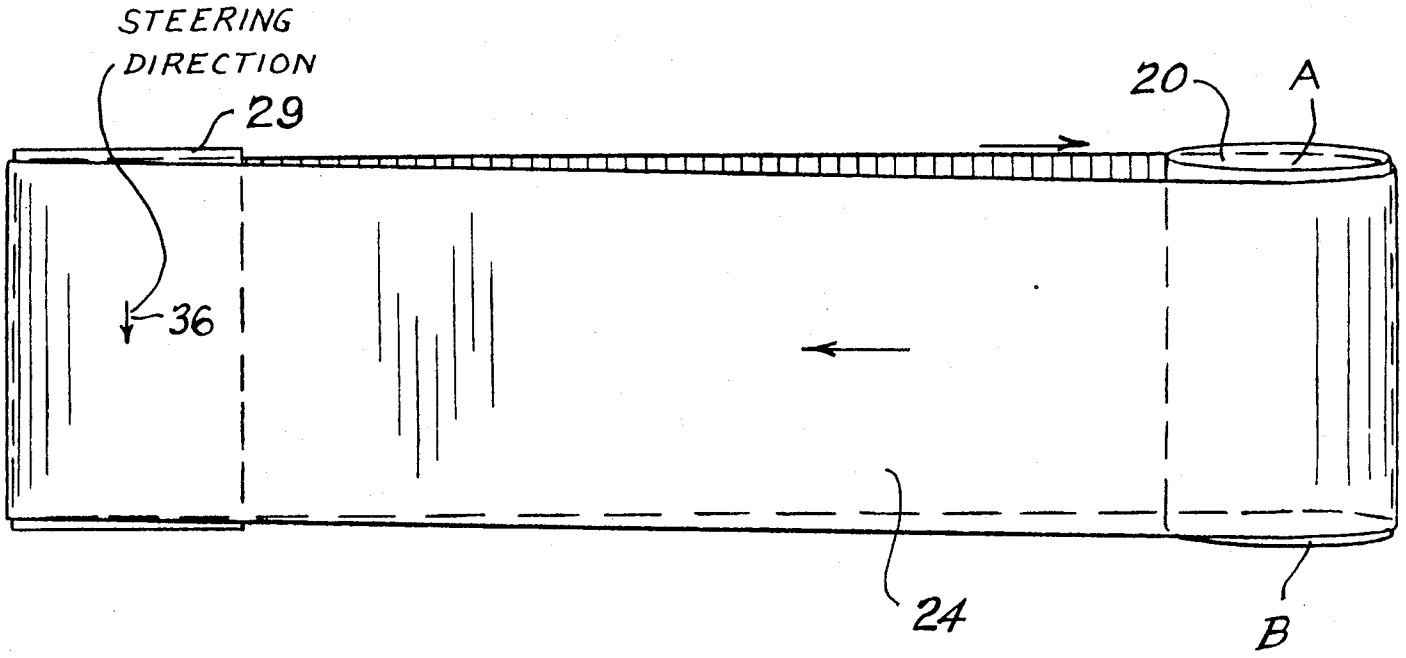
FIG. 3 (PRIOR ART)
FIG. 3 is a schematic top plan view of the upper casting belt and its two pulley rolls 20 and 29 for illustrating the manner in which tilting of the axis of an exit pulley roll 20 causes the revolving belt to be steered as a consequence of its resulting slightly oblique approach to the upstream pulley roll 29.

As shown in FIGS. 2 and 3, the belts 24 and 26 were steered by tilting the axis of the respective exit pulley roll 20 and 22 in the plane perpendicular to the plane of the casting region C, as shown by $\theta$ in FIG. 2. This tilting of an exit pulley roll, for example the roll 20 in FIG. 3, caused the steered belt 24 to approach the entrance pulley 29 slightly obliquely. For example, if the end A of pulley roll 20 were slightly elevated while end B were slightly lowered, as shown in FIG. 3, the casting belt 24 would be caused to be steered in the direction 36. The belt would be steered in the opposite direction if end B were raised while end A were lowered.

Figure 7:
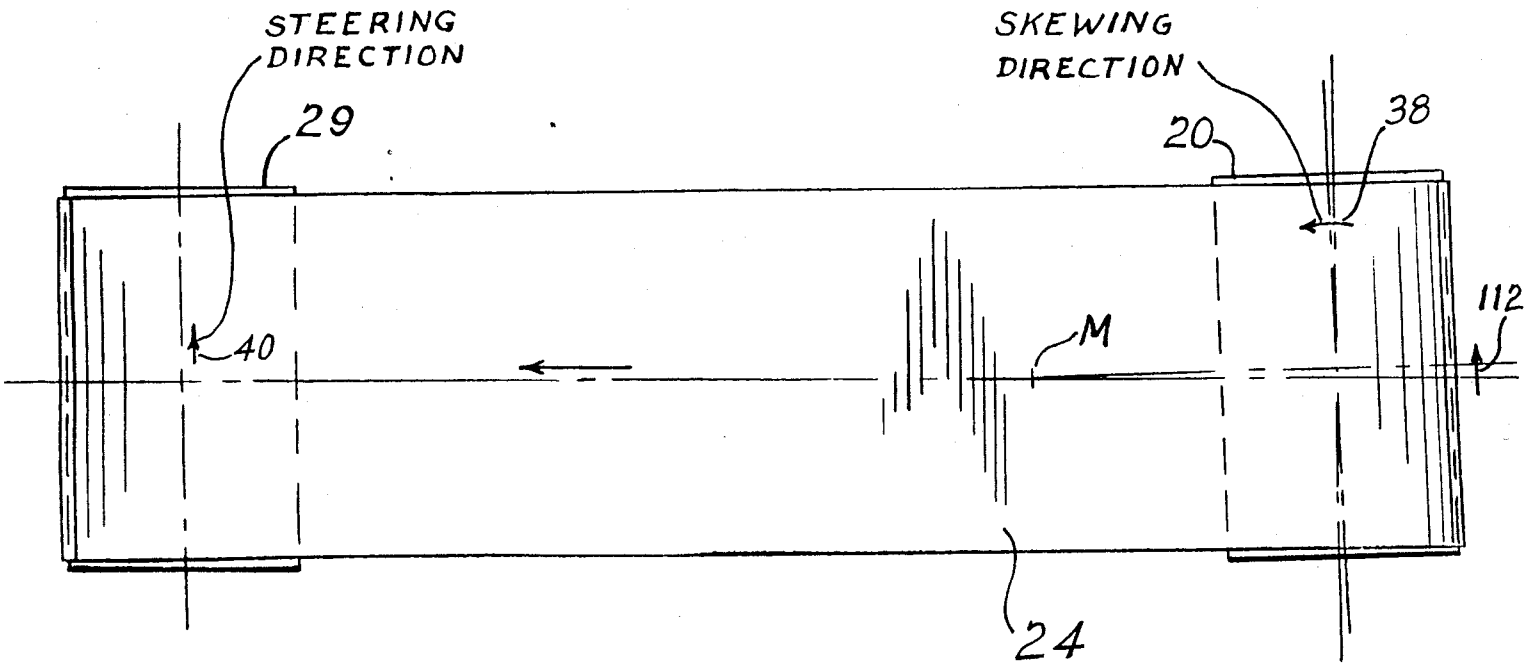
FIG. 7 is a schematic top plan view of the upper casting belt and its two pulley rolls 20 and 29 for illustrating the manner in which lateral skew steering of the exit pulley roll causes the revolving belt 24 to be steered. This

In the lateral-skew steering method and apparatus of the present invention, the axis of the exit pulley roll, for example the roll 20 in FIG. 7, is skewed in a plane parallel with the plane of the casting region and in a plane passing through (coplanar with) the axis of entrance pulley roll 29. Skewing in the direction of the arrow 38—counterclockwise as seen from above—causes the belt 24 to be steered in the direction of the arrow 40. Conversely, skewing of the exit pulley roll in the opposite direction produces steering in the opposite direction from arrow 40.

The skewing of the exit pulley roll 20 causes the revolving belt 24 to approach the entrance pulley roll 29 slightly obliquely and thus causes the belt to progress along the entrance pulley in the desired axial direction for keeping the belt in its desired lateral position in the twin-belt caster. Moreover, the belt is also immediately shifted laterally in the desired steering direction by the lateral skewings of a yoke-mounted exit pulley roll, as will be explained later.

Figure 4:
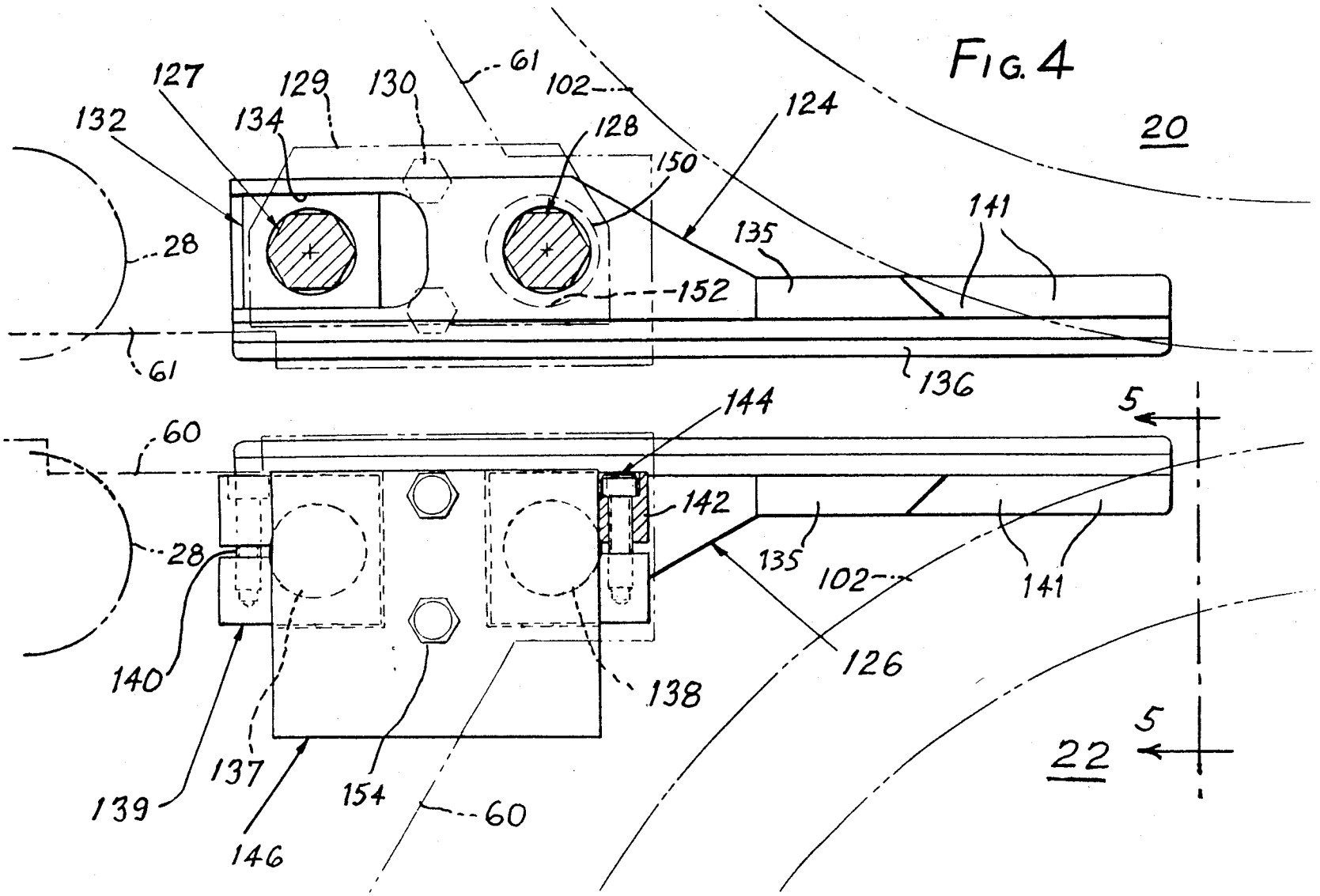
FIG. 4 is a side elevational view of the portion of the casting region immediately upstream of the exit pulley rolls, being shown considerably enlarged as compared with FIG. 1. This
Figure 5:
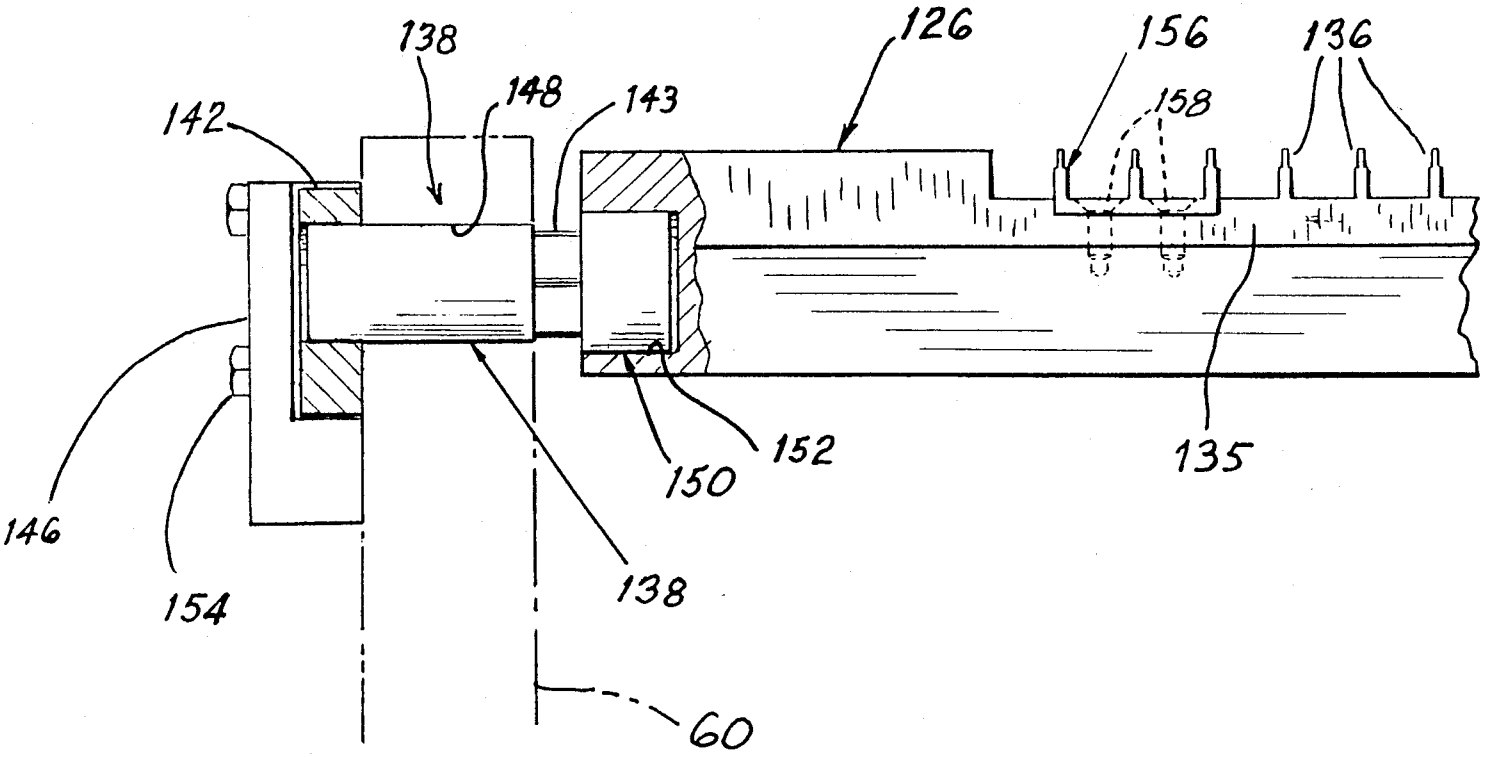
FIG. 5 is a partial elevational and partial sectional view of the lower belt-support platen as seen looking in the upstream direction at 5—5 in FIG. 4.
Figure 6:
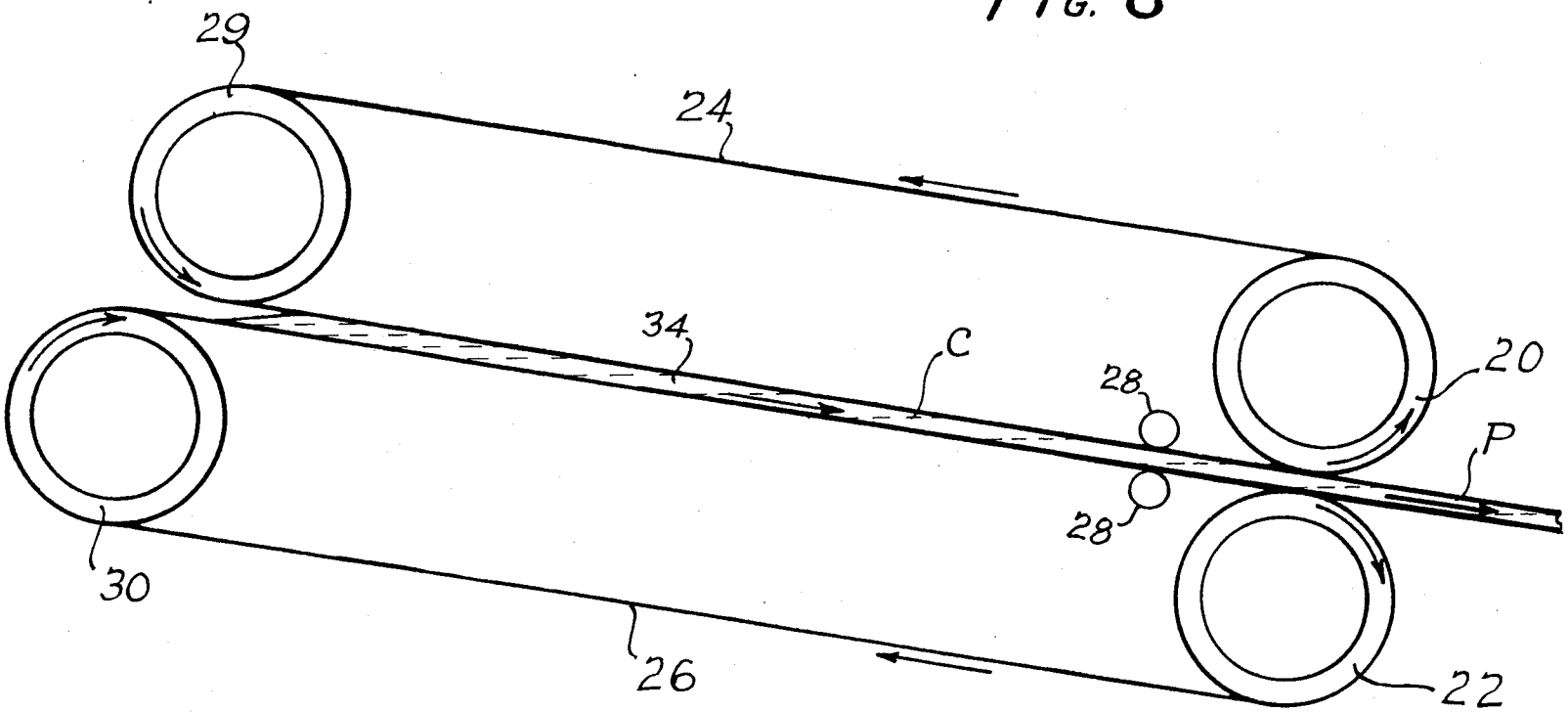
FIG. 6 is a schematic side elevational view similar to FIG. 1 for illustrating that lateral skew steering enables the casting belts to hug the cast product between the last back-up rollers and the exit pulley rolls, because clearance is no longer needed for tilting the axis of each exit pulley roll in a plane perpendicular to the casting plane.

By virtue of this lateral skew steering, the casting belts 24 and 26 are enabled to hug the product P being cast, as shown in FIG. 6, all of the way to the exit pulley rolls 20 and 22, where the belts start to wrap upon the pulley. Thus, there is provided an effective increase in the moving mold length, plus a continuity of heat transfer out of the product being cast. Also, this lateral skew steering enables each casting belt 24 and 26 to be slidably supported adjacent to the caster exit pulley 20 and 22 by means of finned platens as shown in FIGS. 4 and 5, to be described later.

Figure 8:
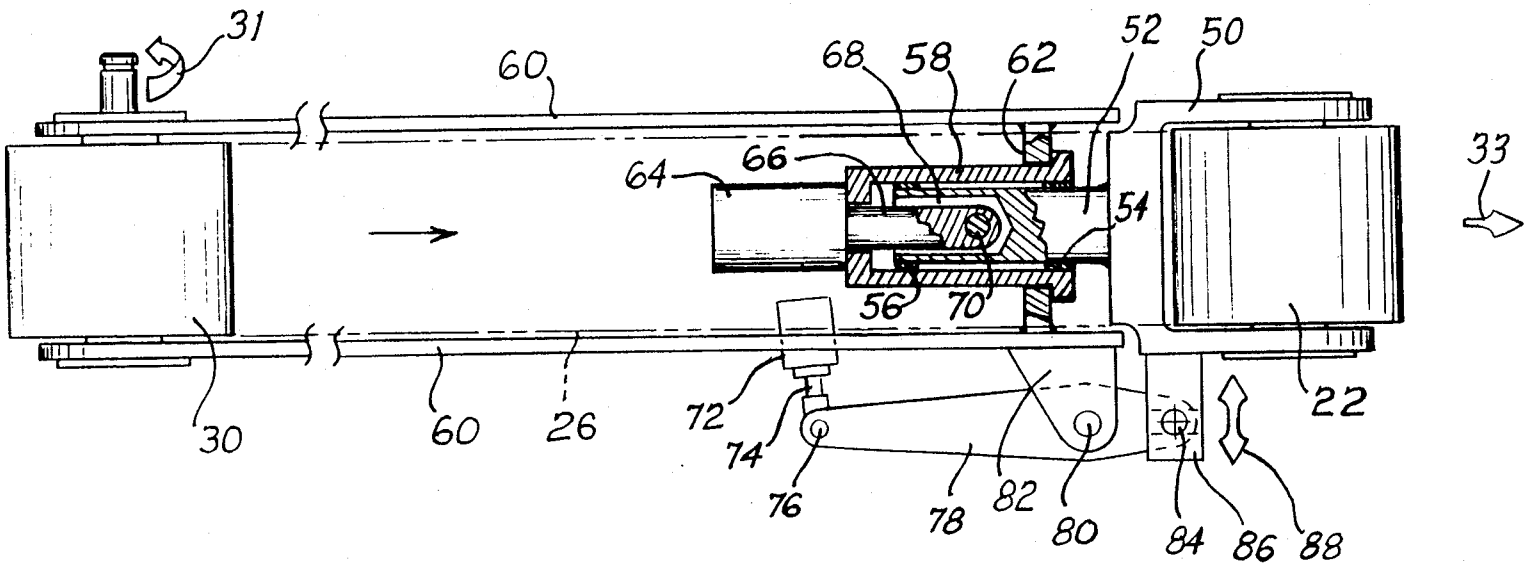
FIG. 8 is a plan view showing the lateral skew steering and belt tensioning apparatus for the lower casting belt.
Figure 9:
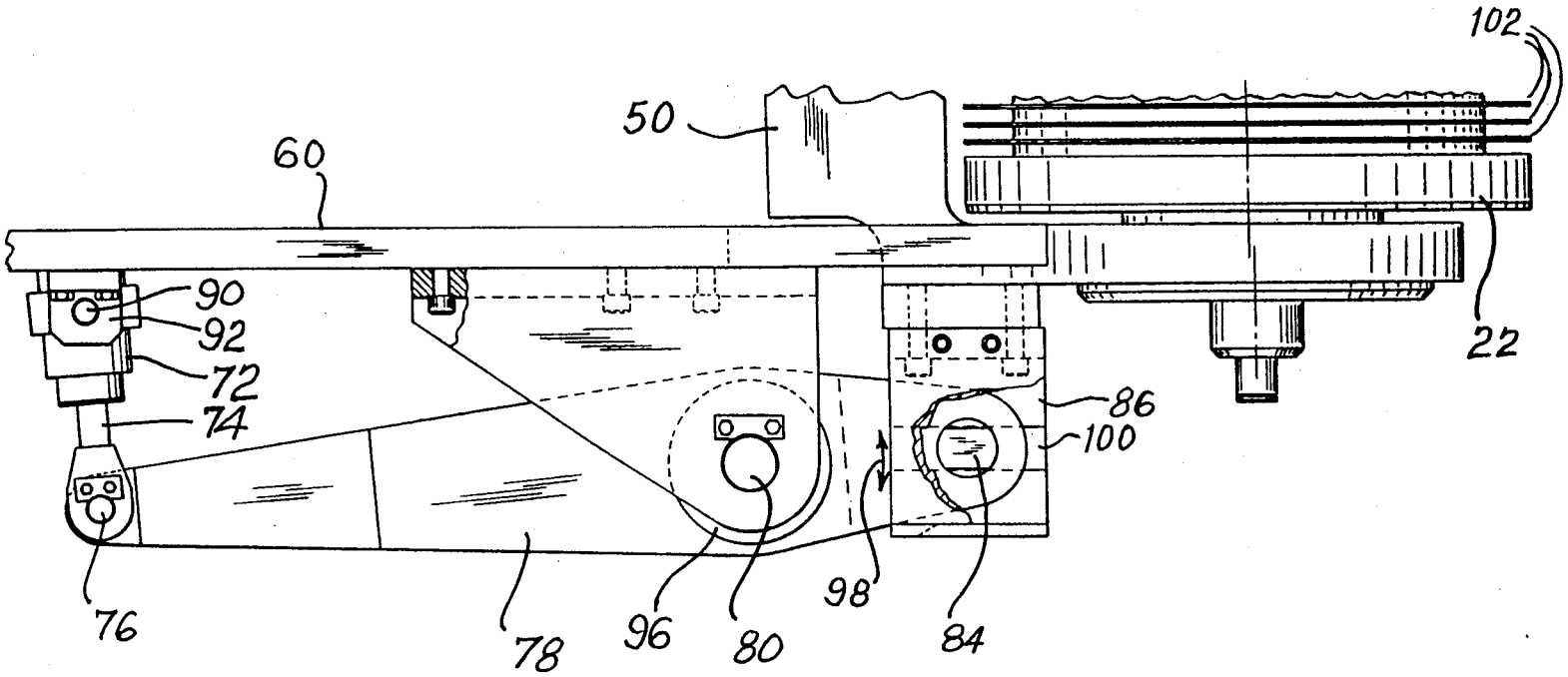
FIG. 9 is an enlargement of a portion of FIG. 8 for illustrating the lateral skew steering apparatus more clearly.
Figure 10:
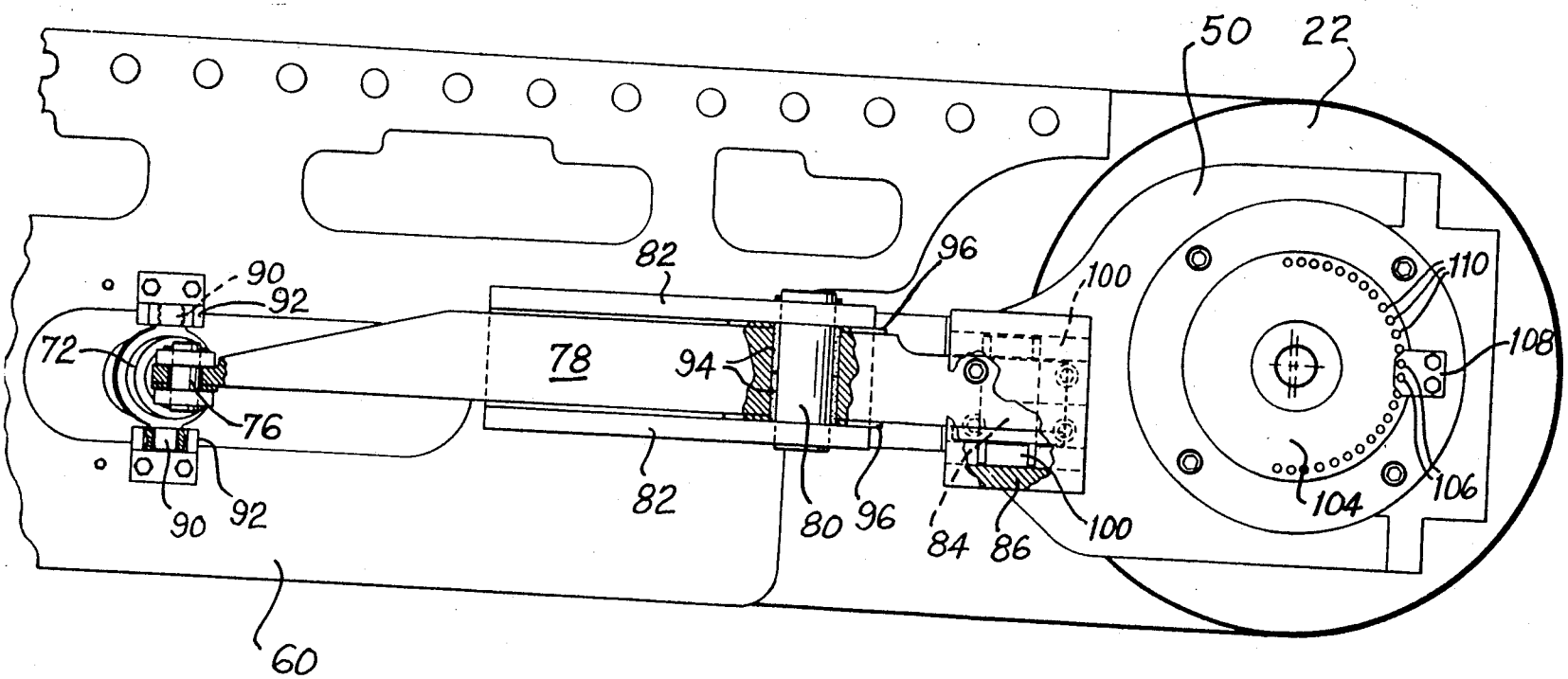
FIG. 10 is a side elevational view of the apparatus of FIG. 9.

FIGS. 8, 9 and 10 show apparatus for producing the lateral skew steering action described above, and such apparatus will be described for the lower belt 26 shown in dashed outline in FIG. 8. The belt 26 is revolved around the entrance and exit pulley rolls 30 and 22 by driving the entrance pulley roll 30, as indicated by the drive arrow 31. The arrow 33 indicates the exiting direction of the cast product P (FIG. 6). The exit pulley roll 22 is carried by a yoke 50 having a slidably mounted support shaft 52. This shaft 52 is mounted in bushings 54 and 56 within a cylindrical support 58 secured to a transverse frame member 62 of the frame 60 of the carriage for the lower casting belt 26.

In order to apply tension to the casting belt 26, there is a large hydraulic-actuated cylinder 64 secured to the support 58 and having a piston rod 66 pinned to the longitudinally disposed, laterally constrained but slidable yoke shaft 52. The piston rod 66 extends into a hollowed socket 68 within the upstream end of the slidable yoke shaft and is attached to this shaft by a pin 70.

Skewing of the yoke 50 is produced by a hydraulic-actuated steering cylinder 72 (FIG. 8) mounted on the carriage frame 60 and having its piston rod 74 connected by a pivot 76 to a steering lever 78. This lever 78 has a fulcrum pivot 80 on a bracket 82 secured to the carriage frame 60. The oposite end of this lever 78 is connected by a pivot 84 to a housing 86 fastened to the yoke 50.

It is noted that this steering lever 78 is a lever of the first class, and its effort arm driven by the piston rod 74 is considerably longer than its load arm connected to the yoke 50 via housing 86. Thus, there is a mechanical advantage provided by this lever 78 in moving the housing 86 and yoke 50, as indicated by the double-ended arrow 88.

The action of the steering cylinder 72 is alternately to push, pull, or be neutral, in response to steering commands. The force 88 so applied to the steel yoke 50 causes the yoke to undergo an elastic angular deflection or skew that is in the plane defined by the axes of rotation of the pulley rolls 22 and 30, i.e., coplanar with that plane—hence the designation coplanar (or lateral) skew steering.

Given the high rigidity of metallic belts, only a very small amount of motion in the transverse direction 88 is either needed or feasible in lateral skew steering. In the present apparatus, the amount is normally 0.020 of an inch (0.5 of a millimeter). This represents an angular deflection of about 1/1000 of a radian or about 3.4 minutes or arc. The upper limit of useful angular deflection has not been explored but is believed to lie within 3/1000 of a radian or 10 minutes of arc. In the apparatus described, the preferred force-applying means at the end of the effort arm of the lever 78—the steering cylinder 72—is a short stroke cylinder, sometimes called a "kicker cylinder," having a total stroke of only about ¼ of an inch (6 millimeters).

By virtue of mounting the belt-tensioning cylinder 64 on a support 58 which in turn is mounted on the carriage frame at 62 near the fulcrum bracket 82 and by using a pivot connection 70 between the piston rod 66 and the slidable yoke shaft 52, the belt-tensioning apparatus is essentially isolated from the yoke 50 in regard to lateral skewing force and motion 88. Thus, advantageously, the belt-tensioning apparatus does not resist or impede the lateral skew steering action 88.

The mounting arrangement for each exit pulley roll advantageously provides an effective mounting point M (FIG. 7), located upstream from the respective exit pulley roll, with said mounting point and the axis of the respective exit pulley roll defining a plane approximately parallel with the plane of the casting region C (FIG. 6).

FIGS. 9 and 10 show that the steering cylinder 72 is mounted on trunnions 90 carried by bearing blocks 92 fastened to the carriage frame 60. The bracket 82 straddles the steering lever 78, which is mounted on sleeve bearings 94 and is positioned on its fulcrum pivot 80 by spacing washers 96. It is noted in FIG. 10 that the portion of the steering lever 78 near the fulcrum pivot 80 is increased in section for providing added strength to resist the bending moment involved in such a lever.

In order to isolate the housing 86 from upstream/downstream movement (right/left in FIG. 10) of the pivot 84 as a result of swinging motion (arrow 98) of the lever 78 around its fulcrum pivot 80, the pivot 84 is mounted on a slide block 100 carried in the housing 86 and slidable in an upstream/downstream relationship relative to the housing 86.

FIG. 9 shows the fins 102 on the exit pulley roll 22 for allowing high velocity cooling water (not shown) travelling along the inside surface of the revolving casting belt 26 (not shown in FIG. 9) to be removed by flowing in the grooves between these fins on the pulley roll 22. The operation of a twin-belt caster including cooling of the casting belts is explained in detail in the reference patents listed in the introduction and incorporated into this specification by reference.

For enabling the alignment adjustment of the axis of the exit pulley roll 22 relative to the carriage frame 60 for precisely aligning this exit pulley roll with the casting plane C (FIG. 6), a pulley roll bearing (not shown) is carried in a rotatable eccentric member 104. This eccentric mounting 104 for the pulley roll bearing is rotated into a desired adjusted position and then is secured in place by keeper pins 106 held in a retainer 108 and engaging in socket holes 110 in the eccentric mounting member 104.

An advantageous and beneficial effect of the lateral skew steering method and apparatus employing the yoke 50 as described is that the exit pulley roll 20 and the belt with it, as is shown in FIG. 7 by the arrow 112, is immediately shifted slightly in the desired steering direction 40 when a steering command causes the steering cylinder 72 to move the yoke 50.

Inviting attention to FIGS. 4 and 5, there are shown an upper and lower support platen 124 and 126, respectively, for the upper and lower casting belts 24 and 26 (FIG. 6). The upper and lower exit pulley rolls 20 and 22 are shown in dashed outline, and their fins are indicated at 102. The upper and lower carriage frames are shown in dashed outline at 61 and 60, respectively.

The upper platen 124 is mounted to the upper carriage frame 61 by means of eccentrically adjustable mounting shafts 127 and 128. Both of these shafts are captured by a block 129 shown in dashed outline and being fastened to the carriage frame 61 by machine screws 130. The upstream shaft 127 is captured vertically by a slider 132 which is slidingly received in a socket recess 134 extending in the upstream/downstream direction in the upper platen 124 for facilitating eccentrically adjustable mounting of this platen in the twin-belt machine. This upper platen includes multiple relatively narrow fins 136 extending in the upstream/-downstream direction (left/right in FIG. 4) and with their working surfaces coplanar with the inside surface of the respective casting belt. The fins restrain bulging of the upper casting belt (not shown) while accommodating high velocity flow of cooling water in the downstream direction along the inside surface of the upper casting belt. The fins of each respective platen 124 and 126 are connected with each other by a web 135. The web is omitted in the areas 141 to provide clearance for meshing with the circular fins 102 of the respective exit rolls 20 and 22.

The lower platen 126 is mounted to the lower carriage frame 60 by means of eccentrically adjustable mounting shafts 137 and 138. The upstream shaft 137 is held by a clamp 139 tightened by a clamp screw 140. The downstream shaft 138 is held by another clamp 142 tightened by a clamp screw 144. A block 146 is secured by screws 154 to the exterior of the lower carriage frame adjacent to the shaft clamps 139 and 142, to adjustably capture them.

The eccentric 150 of the downstream shaft 128 for the upper platen 126 is shown in dashed outline in FIG. 4. The eccentric 150 of the downstream shaft 138 for the lower platen 126 is shown in FIG. 5. These eccentrics 150 are rotatably received in sockets 152 in the respective platens. Each adjustable mounting shaft 127, 128, 137 and 138 includes an exposed concentric hexagonal section 143, to which a wrench may be applied for adjusting the orientation of the eccentrics 150 and hence the vertical position of the respective platens.

For convenience of illustration, FIG. 4 shows the platens 124 and 126 extending horizontally in the upstream/downstream direction. It is to be understood that the casting plane C of this twin-belt caster and of these platens are inclined downwardly in the downstream direction at a suitable angle, for example 6 degrees to the horizontal, as illustrated in FIG. 6.

In FIG. 5 is shown a portion of the lower platen 126 as seen looking in the direction 5—5 in FIG. 4. A portion of the lower carriage frame 60 is shown in dashed outline. The eccentrically adjustable mounting shaft 138 is seen extending through a mounting hole 148 in the frame 60 and terminating in an eccentric cylindrical end 150 received in a hole 152 in the platen 126. A section of mounting shaft 138 is shaped hexagonally to provide for a wrench to adjust the vertical position of platen 126. the platen fins 136 may be provided by removable inserts such as indicated at 156 and held by screws 158.

Figure 11:
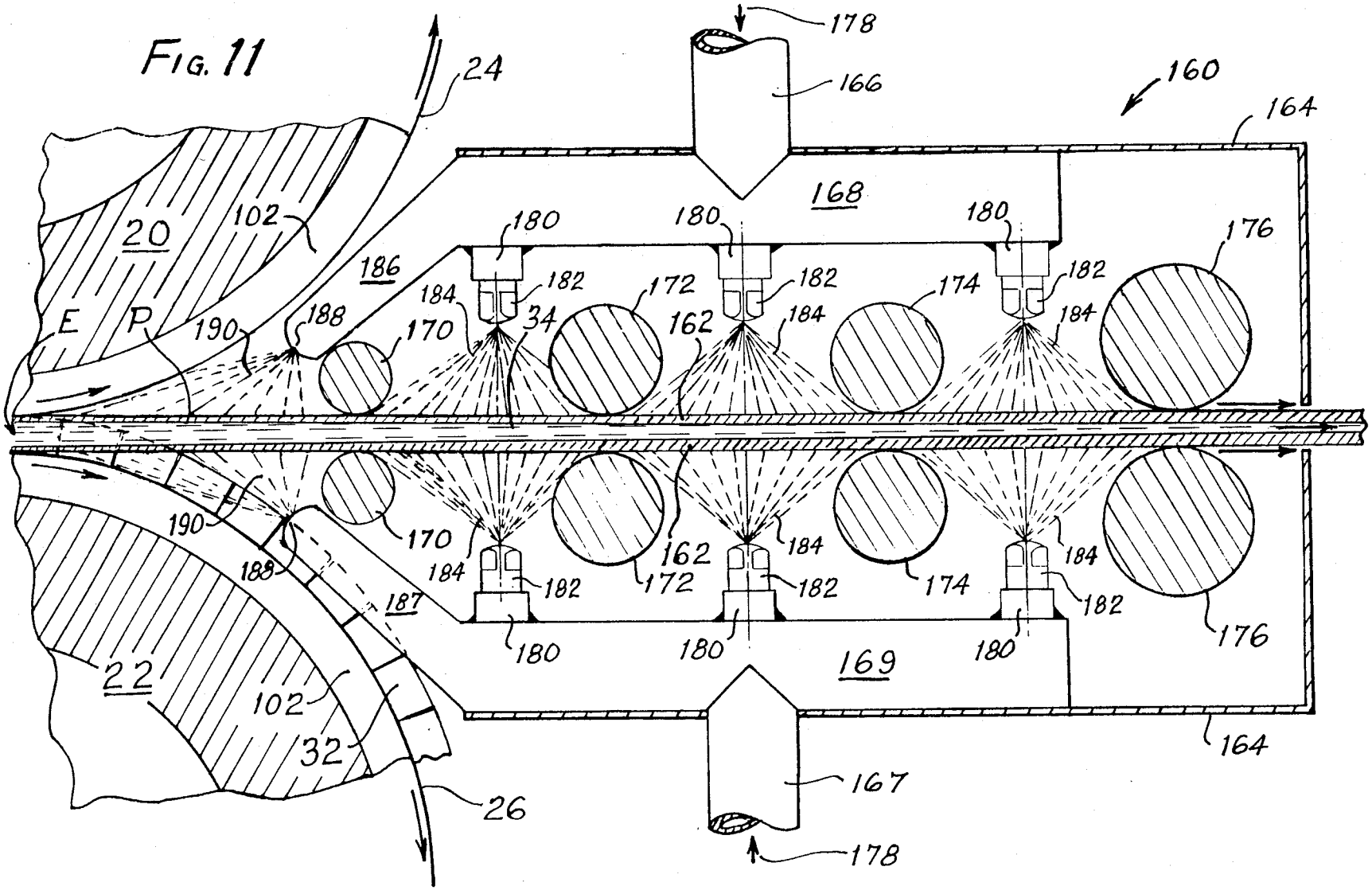
FIG. 11 is a side elevational view, shown partly in section, of the exit containment and cooling apparatus for the cast product exiting from the twin-belt caster.

As is shown in FIG. 11, the cast product P issuing from the twin-belt caster, is contained and supported by exit containment and supporting apparatus 160 positioned immediately adjacent to the revolving casting belts 24 and 26 at the exit E from the casting machine. The purpose of this apparatus 160 is to resist bulging of the relatively thin cast shell 162 which could result from metallostatic pressure of the still molten interior 34 due to the high-speed casting operation and to provide direct spray cooling of the cast product P. When this product is a steel slab having a thickness of the order of about one inch, it is estimated that its molten interior or liquid center 34 may extend downstream from the exit E for a distance of up to about 10 feet in such high-speed continuous casting operation.

For convenience of illustration, the cast product P and its exit apparatus 160 are shown in a horizontal relationship in FIG. 11. It is to be understood that they are inclined downwardly in the downstream direction to match the angle of the casting plane C (FIG. 6).

The exit apparatus 160 comprises: a spray chamber enclosure 164 having suitable exhaust ducting and drainage (not shown); pressurized coolant water supply connections 166, 167 for supplying upper and lower spray manifolds 168, 169 with multiple nozzles to be described; and a plurality of opposed pairs of support and containment rollers 170, 172, 174 and 176.

Pressurized cooling water 178 is supplied through the connections 166 and 167 under a pressure in the range from about 30 pounds per square inch (p.s.i.) to about 120 p.s.i. into the spray manifolds 168, 169. These manifolds 168 and 169 span across the full width of the cast product and have multiple internally threaded pipe couplings 180 welded into ports in the wall of the respective manifold and aimed perpendicularly to the cast product. Into each of these couplings 180 is threaded a spray nozzle 182 for directing a uniformly distributed conical pattern of spray 184 of cooling water onto the cast shell 162. For example, these nozzles are "Full Jet" ® nozzles obtainable from Spraying System Company of Wheaton, Ill. 60187, designed for producing a full cone of spray 184 with uniform distribution of the spray pattern.

It is to be understood that the nozzles 182 are spaced laterally at uniform intervals in three rows extending across the full width of the cast slab P and are sufficiently closely spaced in their respective rows for their sprays 184 to overlap in the lateral direction for producing intense cooling. In the upstream/downstream direction, as seen in FIG. 11, the second row of nozzles 182 is positioned midway between the axes of the second and third rollers 172 and 174, and the third row of nozzles 182 is positioned for their spray patterns to be located midway between the curving surfaces of the third and fourth rollers 174 and 176. The first row of nozzles 182 is positioned approximately midway between the first and second rollers 170, 172, but is offset somewhat in the downstream direction to provide clearance between the spray manifold and the curvature of the revolving casting belts 24, 26.

In order to provide clearance for cooling the cast product P relatively close to the continuous caster exit E while also supporting and containing the cast shell 162, the first opposed pair of rollers 170 have the smallest diameter, for example of the order of 1.75 to 2.00 inches. It is to be understood that each of these rollers 170 is segmented into relatively short segments having intermediate supports and bearings (not shown) for resisting deflection of these relatively small diameter rollers which extend across the full width of the casting product P.

Coolant supply conduits 186 and 187 project into the region between the curving outer surfaces of the respective casting belts 24 and 26 traveling around the exit pulley rolls 20 and 22. These conduits 186 and 187 carry multiple spray nozzles 188 spaced uniformly laterally across the width of the cast slab P for projecting their sprays 190 in laterally overlapping relationship for intense cooling. The nozzles 188 are aimed in the upstream direction toward the caster exit E at an impingement angle of about 45 degrees relative to the plane of the cast product, for causing their sprays 190 to impinge against the cast shell 162 over essentially the entire areas of this shell between the exit E and the first rollers 170. The impingement angle of nozzles 188 may be substantially less than 45 degrees but should not be less than about 10 degrees so as not to force the spray to penetrate beyond the exit E into the mold region C.

It is noted that lower conduit means 187 are arranged to clear the two side dams 32 (only one is seen in FIG. 11) which are travelling out of the caster exit E, straddling the cast product and then curving downwardly, being carried by the outer surface of the lower casting belt 26.

The second and third opposed pairs of rollers 172 and 174 are shown with the same diameter, for example 3 inches each, while the fourth rollers 176 are largest, for example each with a 4 inch diameter. Because of their increased stiffness against bending deflection as compared with rollers 170, the rollers 172 and 174 include fewer segments and fewer intermediate supports and bearings than the first, smallest rollers 170, while the largest fourth rollers 176 may be unsegmented, depending upon the span distance across the full width of the cast slab P.

The containment, support and cooling apparatus 160 shown in FIG. 11 extends for a distance of about 36 inches from the caster exit E. The first set of opposed rollers 170 are shown with their centers positioned within less than twelve inches, for example about 9⅛ inches, from the exit E. The second set of opposed rollers 172 are shown positioned less than ten inches for example about 7¼ inches, from rollers 170 on a center-to-center measure, with the third rollers 174 being less than ten inches for example about 7½ inches, on centers from the second rollers 172 and the fourth rollers 176 being about 7¾ inches on centers from the third rollers 174. Thus, these four sets of rollers all have center-to-center spacings in the range, for example, from about 7 to about 8 inches. The distance between rollers 174 and 176 can be increased up to 14 inches without permitting undesired bulging of the cast shell 162.

Down the pass line about 16 feet from the caster exit E may be located pinch-roll apparatus followed by a rolling miss as discussed in the introduction. Additional similar containment, support and cooling apparatus is employed downstream from this apparatus 160 for continuously casting and rolling a steel slab product P. Such apparatus extends as far as the pinch rolls, comprising pairs of opposed rollers, similar to rollers 176 but much larger in diameter, with direct impingement cone spray nozzles positioned between these rollers, similar to the nozzles 182.

It is noted that the outer surfaces (the casting surfaces) of the belts 24 and 26 become wet from the sprays 190. Thus, it is important to dry thoroughly the outer surfaces of both belts during their return travel (please see FIG. 6) to the entrance pulley rolls 29 and 30. Such thorough drying of the outer belt surfaces is accomplished by air blasts; the initial blasts nearer the exit pulley rolls 20, 22 are air at room temperature. The final blasts nearer the entrance pulley rolls 29, 30 are heated air at sufficiently high temperature for completely, evaporating any residual moisture clinging to the belt surface.

SPECIFIC IMPROVED RESULT OF EMPLOYING THE INVENTION

Sustained casting speeds of 480 inches per minute (40 feet per minute) were achieved for 1-inch (25.4 millimeters) cast thickness of low-carbon steel of 17 inches (432 millimeters) width, employing the method and apparatus of the present invention with an effective moving mold length of 75 inches (1905 milimeters).

Although a specific presently preferred emobodiment of the invention has been disclosed herein in detail, it is to be understood that these examples have been described for purposes of illustration. This disclosure is not to be construed as limiting the scope of the invention, since the described apparatus and method may be changed in details by those skilled in the art, in order to adapt these apparatus and method of casting metal shapes to be useful in particular continuous casting situations without departing from the spirit and scope of the invention as claimed in the following claims, including equivalents of the claimed elements.

We claim:

1. In a method for achieving high-speed casting in a continuous casting installation for steel wherein a twin-belt casting machine having upper and lower casting belts revolving respectively around upper and lower exit pulley rolls is producing steel cast product for feeding into a regular rolling mill having minimum rolling speed requirements, wherein the respective revolving casting belt travels past a final backup roller located upstream from the respective exit pulley roll between the revolving casting belts and wherein the cast steel product is issuing from an exit located between said exit pulley rolls, the method comprising the steps of:

causing each casting belt to hug the product being cast in the region between said final back-up roller and the respective exit pulley roll, applying first opposed rolling contact to the cast product within less than twelve inches from said exit for supporting and containing the cast steel product, applying at least second and third opposed rolling contact to the cast product downstream from said first opposed rolling contact spaced on centers less than ten inches between successive rolling contact for further supporting and containing the cast steel product, directly impinging first water spray onto the cast steel product between said exit and said first rolling contact for cooling the cast steel product, directly impinging at least second and third spray onto the cast steel product upstream from the second and third opposed rolling contact, respectively, for further cooling the cast steel product.

2. The method for achieving high-speed casting as claimed in claim 1, including the step of:

aiming said first water spray in an upstream direction at an angle inclined toward said exit for impinging on the cast steel product near said exit, said angle being relative to the cast steel product and being an acute angle greater than about ten degrees.

3. The method for achieving high-speed casting as claimed in claim 1 wherein said revolving casting belts define a casting plane between them, and:

said step of causing each casting belt to hug the product being cast in the region between said final backup roller and the respective exit pulley roll includes steering the revolving casting belt by laterally skewing the exit pulley roll in parallel relationship with said casting plane.

4. The method for achieving high-speed casting as claimed in claim 1 wherein each of said revolving casting belts has an outside surface for defining a moving mold and an inside surface for coolng the belt with liquid coolant, including the steps of:

providing a pair of platens each having longitudinally extending parallel coplanar fins, placing the fins on one of said platens in sliding contact with the inside surface of one of the casting belts in said region between the respective final backup roller and the respective exit pulley roll with said fins extending in the upstream/downstream direction for permitting cooling of the casting belt and for causing the casting belt to hug the cast product, and placing the fins of the other of said platens in sliding contact with the inside surface of the other of said casting belts in said region between the respective final backup roller and the respective exit pulley roll with said fins extending in the upstream/downstream direction for permitting cooling of the casting belt and for causing the casting belt to hug the cast product.

5. The method for achieving high-speed casting as claimed in claim 3 and wherein each of said revolving casting belts has an outside surface travelling in opposed relation to the outside surface of the other casting belt for defining a moving mold planar casting region between them and each has an inside surface for cooling the belt with coolant flowing longitudinally along the inside surface, including the steps of:

providing a pair of platens each having longitudinally extending parallel coplanar fins, placing the fins of one of said platens in sliding contact with the inside surface of one casting belt in said region between the respective final backup roller and the respective exit pulley with said fins extending longitudinally along the inside surface of said one belt for accommodating coolant flowing longitudinally along the inside surface and for causing the outside surface of said one belt to hug the cast product, and placing the fins of the other of said platens in sliding contact with the inside surface of the other casting belt in said region between the respective final backup roller and the respective exit pulley roll with said fins extending longitudinally along the inside surface of said other belt for accommodating coolant flowing longitudinally along the inside surface and for causing the outside surface of said other belt to hug the cast product.

6. The method for achieving high-speed casting as claimed in claim 1 including the steps of:

applying fourth opposed rolling contact to the cast steel product downstream from said third opposed rolling contact and being spaced on centers less than fourteen inches from said third rolling contact, and directly impinging fourth water spray onto the cast steel product between said third and fourth opposed rolling contact.

7. In a method for achieving high-speed casting in a continuous casting installation for steel wherein a twin-belt casting machine having upper and lower casting belts revolving respectively around upper and lower exit pulley rolls is producing steel cast product for feeding into a regular rolling mill having minimum rolling-speed requirements, wherein said revolving casting belts define a planar moving mold casting region between them, wherein the respective revolving casting belt travels past a final backup roller located upstream from the respective exit pulley roll and wherein the cast steel product is discharged from between the revolving casting belts at an exit located between said exit pulley rolls, the method comprising the steps of:

steering each revolving casting belt by laterally skewing the respective exit pulley roll around which the casting belt is revolving, said lateral skewing of the exit pulley roll being in coplanar relationship with said planar moving mold casting region for enabling each revolving casting belt to hug the product being cast in the region between said final backup roller and the respective exit pulley roll, applying opposed rolling contact to the cast steel product at a bulge-resisting-effective distance from said exit, said bulge-resisting-effective distance preventing significant bulging of a solidified shell of said cast steel product enclosing a molten steel interior, and directing water spray onto said solidified shell between said exit and said opposed rolling contact and aiming said water spray in an upstream direction at an angle inclined toward said exit, said angle being relative to said solidified shell and being an acute angle greater than about ten degrees.

8. The method for achieving high-speed casting as claimed in claim 7, wherein each of said revolving casting belts has an outside surface in spaced opposed relationship with the outside surface of the other casting belt for defining said moving mold casting region between them and has an inside surface for cooling the belt with liquid coolant traveling longitudinally along the inside surface, said method including the steps of:

providing a pair of platens each having longitudinally extending parallel coplanar fins, placing the fins of one of said platens in sliding contact with the inside surface of one casting belt in said region between the respective final backup roller and the respective exit pulley roll with said fins extending longitudinally along the inside surface of said one belt for accommodating coolant flowing longitudinally along the inside surface and for causing the outside surface of said one belt to hug the cast product, and placing the fins of the other of said platens in sliding contact with the inside surface of the other casting belt in said region between the respective final backup roller and the respective exit pulley roll with said fins extending longitudinally along the inside surface of said other belt for accommodating coolant flowing longitudinally along the inside surface and for causing the outside surface of said other belt to hug the cast product.

9. In a method for steering the casting belts of a twin-belt casting machine having upper and lower casting belts revolving respectively around upper and lower exit pulley rolls each having an axis of rotation and wherein said upper and lower casting belts travel in opposed spaced relationship defining a moving mold casting region between them, said moving mold casting region being planar, the method comprising:

skewing the axis of the upper exit pulley roll in a first plane which is parallel with said planar moving mold casting region for steering the upper casting belt, and skewing the axis of the lower exit pulley roll in a second plane which is parallel with said planar moving mold casting region for steering the lower casting belt.

10. The method for steering each of the revolving casting belts of the twin-belt casting machine as claimed in claim 9, comprising the further steps of:

shifting the upper pulley roll in said first plane simultaneously with said skewing, said shifting of said upper pulley roll being in a direction in which the upper belt is being steered, shifting the lower pulley roll in said second plane simultaneously with said skewing, and said shifting of said lower pulley roll being in a direction in which the lower belt is being steered.

11. In a continuous casting installation for steel wherein a twin-belt casting machine having upper and lower casting belts revolving respectively around upper and lower exit pulley rolls is producing steel cast product for feeding into a regular rolling mill having minimum rolling-speed requirements, wherein the respective revolving casting belt travels past a final backup roller located upstream from the respective exit pulley roll, wherein the cast steel product is issuing from between the revolving casting belts at an exit between said exit pulley rolls and wherein said cast steel product includes a solidified shell enclosing a molten steel interior, a system for achieving high-speed casting by said twin-belt casting machine for meeting the minimum rollng-speed requirements of said regular rolling mill comprising:

means for causing each casting belt to hug the product being cast in the region between said final backup roller and the respective exit pulley roll, a pair of opposed rollers in rolling contact with said solidified shell downstream from said exit, said pair of opposed rollers being positioned at a bulge-resisting-effective distance from said exit for resisting significant bulging of said solidified shell, spray nozzle means positioned above and below the cast steel product for applying cooling sprays of water to said solidified shell from above and from below in a region between said exit and said pair of opposed rollers, and said spray nozzle means being aimed toward said solidified shell in an aiming direction at an acute angle relative to said solidified shell and said aiming direction being inclined upstream toward said exit for cooling the solidified shell adjacent to said exit.

12. The system for achieving high-speed casting as claimed in claim 11, further comprising:

a pair of platens each having longitudinally extending parallel coplanar fins, and means mounting said platens in sliding contact with the upper and lower casting belts on an opposite surface of each belt from the product being cast in a region between said final backup roller and the respective exit pulley roll.

13. The system for achieving high-speed casting as claimed in claim 11, wherein said means for causing each belt to hug the product being cast in the region between said final backup roller and the respective exit pulley roll includes:

steering means for steering the respective revolving casting belt, said steering means laterally skewing the respective exit pulley roll in coplanar relationship with said solidified shell of the cast steel product.

14. The system for achieving high-speed casting as claimed in claim 13, in which:

said steering means includes means for shifting the respective exit pulley roll laterally in coplanar relationship with said solidified shell simultaneously with the lateral skewing of the respective pulley roll, said shifting of the respective exit pulley roll being in a direction which is the same as a direction of steering the respective revolving casting belt by said skewing thereof for providing immediate steering response.

15. In a twin-belt continuous casting machine in which a planar-moving mold casting region is defined between spaced parallel portions of upper and lower revolving casting belts and wherein said upper and lower casting belts travel partially around respective upper and lower exit pulley rolls each having an axis of rotation, apparatus for steering the revolving casting belts comprising:

first mounting means for mounting said upper exit pulley roll providing a first effective mounting point located upstream from said upper exit pulley roll, said first effective mounting point and said axis of said upper exit pulley roll defining a first plane parallel with said planar moving mold casting region, first means for skewing said upper exit pulley roll in said first plane around said first effective mounting point for steering the upper belt laterally, second mounting means for mounting said lower exit pulley roll providing a second effective mounting point located upstream from said lower exit pulley roll, said second effective mounting point and said axis of said lower exit pulley roll defining a second plane parallel with said planar moving mold coasting region, and second means for skewing said lower exit pulley roll in said second plane around said second effective mounting point for steering the lower belt laterally.

16. Apparatus for steering the revolving casting belts as claimed in claim 15, in which:

said first mounting means includes tensioning means for moving the axis of the upper exit pulley roll in the downstream direction in said first plane for tensioning the upper casting belt, and said second mounting means includes tensioning means for moving the axis of the lower exit pulley roll in the downstream direction in said second plane for tensioning the lower belt.

17. Apparatus for steering the revolving casting belts as claimed in claim 16, in which:

said first mounting means includes a first yoke rotatably carrying the upper exit pulley roll and having a first shaft extending perpendicular to the axis of the upper exit pulley roll, said first shaft having an axis lying in said first plane, said first shaft being slidable in an axial direction, said first tensioning means being coupled to said first shaft for axially sliding said shaft downstream for tensioning the upper belt, said second mounting means includes a second yoke rotatably carrying the lower exit pulley roll and having a second shaft extending perpendicular to the axis of the lower exit pulley roll, said second shaft having an axis lying in said second plane, said second shaft being slidable in a axial direction, and said second tensioning means being coupled to said second shaft for axially sliding said shaft downstream for tensioning the lower belt.

18. Apparatus for steering the casting belts as claimed in claim 15, in which:

said first means for skewing said upper exit pulley roll includes a first lever having a mechanical advantage, and said second means for skewing said lower exit pulley roll includes a second lever having a mechanical advantage.

19. Apparatus for steering the casting belts as claimed in claim 17, in which:

said first means for skewing said upper exit pulley roll includes a first lever coupled to said first yoke and having a mechanical advantage, and said second means for skewing said lower exit pulley roll includes a second lever coupled to said second yoke and having a mechanical advantage.

20. The method for steering a casting belt of a twin-belt continuous metal casting machine to run centrally, said machine being arranged to cast directly from molten metal wherein the metal is introduced into a planar moving mold, said planar moving mold being defined between the surfaces of two opposed, moving endless, longitudinally tensed, flexible casting belts each revolving around at least two main pulley rolls, one of said pulley rolls being a steering pulley roll located at the exit of the moving mold, each of said pulley rolls having an axis of rotation and said pulley rolls being mounted at opposite ends of a carriage frame with their axes being in parallel relationship with the planar moving mold region, the method comprising:

inducing longitudinal tensile force within said casting belt by exerting outward force upon the axis of at least one said pulley, said outward force being exerted in a direction away from the older axis revolving the longitudinally tensed belt in a course around at least two said main pulley rolls, exerting upon the steering pulley roll a force resulting in a minute angular skew of the axis of said steering pulley in a plane that is essentially parallel to said planar moving mold, whereby said belt is steered centrally on said main pulley rolls, while at the same time said steering pulley roll remains in parallel relationship to said planar moving mold cavity, and thereby said casting belt hugs the freezing cast product up to the point at which said belt wraps upon said steering pulley roll, thereby lengthening the planar moving mold of said twin-belt metal casting machine.

21. The method as claimed in claim 20 in which the said steering pulley roll is rotatably mounted in a yoke, which yoke is in turn supported on its own longitudinally disposed slidable shaft extending perpendicular to the axis of said steering pulley roll, with the further step of proportioning and laterally guiding and supporting said slidable shaft and the said yoke to afford elastically flexible pivoting of said steering pulley around an effective pivot point in said plane, in response to said force for producing said minute angular skew.

22. The method as claimed in claim 20, in which said minute angular skew is limited to 10 minutes of arc.

23. A belt-tensioning and steering system for use in a twin-belt continuous metal casting machine in which a planar moving mold region is defined between spaced parallel portions of two casting belts, said system comprising:

a carriage frame for supporting and revolving one of said two casting belts, which carriage frame bears a pair of main pulley rolls at its opposite end, the axes of said pulley rolls defining a plane parallel to the plane of said planar moving mold region, a yoke upon which one of said pulley rolls is mounted, which yoke incorporates a longitudinally disposed, laterally constrained, sliding guide member mounted on said carriage frame and extending perpendicular to the axis of said one pulley roll, force-applying means coupled between said carriage frame and said yoke for producing an elastic angular skew of said yoke in a plane essentially parallel to that of said planar moving mold region for steering the revolving casting belt, and belt-tensioning means coupled between said carriage frame and said sliding guide member for sliding said member in a direction away from the pulley roll at the opposite end of the carriage frame, for tensioning the belt.

24. The belt-tensioning and steering system of claim 23, in which said force-applying means comprises:

a longitudinally disposed lever of the first class, said lever having a fulcrum mounted on said carriage frame and having an effort arm longer than a load arm, said effort arm being coupled to a force-generating means mounted on said carriage frame, and said load arm being coupled to said yoke.

* * * * *